US008625830B2

(12) United States Patent
Probst et al.

(10) Patent No.: US 8,625,830 B2
(45) Date of Patent: Jan. 7, 2014

(54) MODULAR HEARING DEVICE

(75) Inventors: Daniel Probst, Zurich (CH); Roland Hug, Hinwil (CH)

(73) Assignee: Phonak AG, Stafa (CH)

( * ) Notice: Subject to any disclaimer, the term of this patent is extended or adjusted under 35 U.S.C. 154(b) by 156 days.

(21) Appl. No.: 13/131,742

(22) PCT Filed: Dec. 2, 2008

(86) PCT No.: PCT/EP2008/066575

§ 371 (c)(1),
(2), (4) Date: May 27, 2011

(87) PCT Pub. No.: WO2009/083372

PCT Pub. Date: Jul. 9, 2009

(65) Prior Publication Data

US 2011/0243357 A1 Oct. 6, 2011

(51) Int. Cl.
*H04R 25/00* (2006.01)

(52) U.S. Cl.
USPC ..... 381/328; 381/312; 381/322

(58) Field of Classification Search
USPC ..... 381/312, 322, 328, 330, 381
See application file for complete search history.

(56) References Cited

U.S. PATENT DOCUMENTS

| | | | | |
|---|---|---|---|---|
| 5,761,319 | A * | 6/1998 | Dar et al. | 381/330 |
| 5,987,146 | A | 11/1999 | Pluvinage et al. | |
| 6,445,799 | B1 * | 9/2002 | Taenzer et al. | 381/71.6 |
| 6,556,686 | B1 * | 4/2003 | Weidner | 381/312 |
| 6,700,983 | B1 * | 3/2004 | Bøgeskov-Jensen et al. | 381/322 |
| 7,006,647 | B1 * | 2/2006 | Wuersch | 381/324 |
| 7,110,562 | B1 | 9/2006 | Feeley et al. | |
| 2007/0183612 | A1 * | 8/2007 | Ochsenbein et al. | 381/322 |
| 2008/0123866 | A1 | 5/2008 | Rule | |

FOREIGN PATENT DOCUMENTS

| | | | |
|---|---|---|---|
| DE | 3625891 | A1 | 2/1988 |
| DE | 10 2005 006 404 | B3 | 8/2006 |
| EP | 1909536 | A2 | 4/2008 |
| WO | 96/41498 | A1 | 12/1996 |
| WO | 98/43567 | A1 | 10/1998 |
| WO | 98/44763 | A1 | 10/1998 |
| WO | 2008/010716 | A2 | 1/2008 |

OTHER PUBLICATIONS

International Search Report for PCT/EP2008/066575 date Oct. 30, 2009.
Written Opinion for PCT/EP2008/066575 date Oct. 30, 2009.

* cited by examiner

*Primary Examiner* — Suhan Ni
(74) *Attorney, Agent, or Firm* — Pearne & Gordon LLP

(57) ABSTRACT

The hearing device comprises an outer part to be worn behind a hearing device user's ear, an inner part to be worn within the hearing device user's ear, and a connecting portion operationally interconnecting said outer part and said inner part. An output transducer is comprised in said outer part or in said connecting portion. Said inner part comprises an input transducer and, operationally interconnected between said input transducer and said output transducer, a signal processing unit .

19 Claims, 2 Drawing Sheets

MODULAR HEARING DEVICE

TECHNICAL FIELD

The invention relates to a hearing device and to a method of operating a hearing device. It relates to methods and apparatuses according to the opening clauses of the claims.

Under a hearing device, a device is understood, which is worn in or adjacent to an individual's ear with the object to improve the individual's acoustical perception. Such improvement may also be barring acoustic signals from being perceived in the sense of hearing protection for the individual. If the hearing device is tailored so as to improve the perception of a hearing impaired individual towards hearing perception of a "standard" individual, then we speak of a hearing-aid device. With respect to the application area, a hearing device may be applied behind the ear, in the ear, completely in the ear canal or may be implanted, wherein in particular in the present patent application, the hearing device may comprise or consist of different parts which are worn in different ones of the named locations.

Under audio signals we understand electrical signals, analogue and/or digital, which represent sound.

BACKGROUND OF THE INVENTION

From DE 10 2005 006 404 B3, an In-The-Ear hearing device is known, which can temporarily be complemented by a supplementary module attachable to a hearing device user's head. The In-The-Ear hearing device has all components and functionalities required for operation, whereas the supplementary module can change or add functionalities.

In U.S. Pat. No. 5,987,146, an open ear canal hearing aid system is disclosed which comprises a plurality of ear canal tubes sized for positioning in an ear canal of a user so that the ear canal is at least partially open for directly receiving ambient sounds. The hearing aid system comprises a case to which the ear canal tubes are connected and which is designed to fit behind a user's ear. In said case, a sound processor is arranged for amplifying ambient sounds received through one of the ear canal tubes and for producing processed sounds and for supplying the processed sounds to the second ear canal tube. A speaker is arranged within said case, and a microphone is arranged at that end of one of the ear canal tubes which is located in the ear canal.

In WO 2008/010716 A2, a hearing-aid device is presented, which comprises a device housing intended and adapted to be worn outside an ear of a user and which co-acts with an in-the-ear part. The in-the-ear part is physically separated from the device housing but electronically connected thereto and comprises a microphone and a loudspeaker. The device housing or the in-the-ear part comprises a digital processing device in which sound picked up by the microphone is processed, and the processed sound is fed to the loudspeaker.

SUMMARY OF THE INVENTION

One object of the invention is to create an alternative type of hearing device. In addition, a corresponding method for operating a hearing device shall be provided.

Another object of the invention is to provide a hearing device comprising a very small In-The-Ear part.

Another object of the invention is to provide a hearing device with particularly natural directional clues, in particular a hearing device which preserves the hearing device user's heard-related transfer function (HRTF) particularly well.

Another object of the invention is to provide a possibility to individualize a hearing device in a particularly simple way.

Another object of the invention is to provide a possibility to adapt a hearing device to the needs and preferences of a user ("hearing device fitting") in a particularly simple way, in particular in case of varying needs or preferences.

Another object of the invention is to provide a hearing device, components of which can be particularly easily replaced.

Another object of the invention is to provide a particularly failure-insensitive, in particularly corrosion-insensitive hearing device.

Further objects emerge from the description and embodiments below.

At least one of these objects is at least partially achieved by apparatuses and methods according to the patent claims.

The hearing device comprises an outer part to be worn behind a hearing device user's ear, an inner part to be worn within the hearing device user's ear, and a connecting portion operationally interconnecting said outer part and said inner part;

wherein an output transducer is comprised in said outer part or in said connecting portion, and wherein said inner part comprises an input transducer and, operationally interconnected between said input transducer and said output transducer, a signal processing unit.

The outer part can also be referred to as BTE part (Behind-The-Ear part), and the inner part can also be referred to as ITE part (In-The-Ear part). The inner part can in particular be an ITC part (In-The-Canal part) or a CIC part (Completely-In-the-Canal part).

The output transducer is a means for generating acoustic sound, in particular from audio signals.

Through this, the inner part can be particularly small, since the output transducer is not arranged therein, but arranged in the outer part or in the connecting portion.

Furthermore, with the output transducer arranged in the outer part or in the connecting portion, problems caused by ear wax at or in the output transducer are very unlikely to occur.

Furthermore, from an electronics and a signal transmission point of view, it is advantageous to have the input transducer (which usually generates relatively weak signals) close to the signal processing unit. This reduces the amount of stray signals and electromagnetic interference, thus providing particularly high quality audio signals.

Furthermore, having the input transducer in the user's ear canal or at the entrance thereof ensures that the user has a particularly well and natural hearing experience, because the natural directional clues in particular the HRTFs are largely preserved.

Furthermore, with the output transducer arranged in the outer part or in the connecting portion and the input transducer and the signal processing unit arranged in the inner part, a modular hearing device can be realized which allows to replace or add or remove parts of the hearing device and corresponding functionalities in a convenient fashion, in particular in conjunction with fitting of the hearing device in which case the hearing device has to be functionally, typically electrically connected to an external unit such as a fitting system.

In one embodiment, the output transducer is an output mechanical-to-electrical converter, in particular a loudspeaker, also referred to as receiver.

In one embodiment, the input transducer is an input mechanical-to-electrical converter, e.g., a microphone.

In one embodiment, the inner part is inoperable without said outer part because no output transducer or no electrical-to-acoustical converter is provided in the inner part.

In one embodiment, no signal processing unit, more particularly no audio signal processing unit is provided in said outer part.

In one embodiment, said outer part is detachable from said inner part. This strongly facilitates a replacement of one of said parts, in particular of the outer part.

In one embodiment, the hearing device consists of said outer part and said inner part and said connecting portion.

In one embodiment, said connecting portion is detachably connected to said outer part or to said inner part or to both, said outer part and said inner part. This strongly facilitates the exchange of parts of the hearing device.

In one embodiment, a part of said hearing device comprising said output transducer is detachably connectable to at least a portion of said outer part. This strongly facilitates the removal of parts of the hearing device, but still allows to program and fit the hearing device while at least said part is removed.

In one embodiment, said connecting portion comprises a plug and said outer part or said inner part comprises a corresponding socket or vice versa, i.e. said connecting portion comprises a socket and said outer part or said inner part comprises a corresponding plug.

In one embodiment, said connecting portion comprises a tube member for providing guidance for acoustic sound outputted from said output transducer to said inner part. In one embodiment, said tube member provides guidance for said acoustic sound through said inner part.

In one embodiment, said hearing device comprises a data storage unit comprising data individual to said hearing device user, wherein said data storage unit is comprised in said inner part. In one embodiment, said data individual to said hearing device user comprise signal processing parameter settings individual to said hearing device user.

In one embodiment, no data individual to said hearing device user are comprised in said outer part.

In one embodiment, an energy storage unit suitable for powering said signal processing unit is comprised in said inner part. In one embodiment, said energy storage unit is a rechargeable energy storage unit, e.g., a capacitor or an accumulator. A rechargeable energy storage unit has the advantage that the hearing device user can have at least two of those, one in use in the hearing device and another one being recharged in the meantime.

In one embodiment, no energy storage unit suitable for powering said signal processing unit is comprised in said outer part. This way, the inner part can be very small.

In one embodiment, said inner part is inoperable without said outer part because of lacking an energy storage unit suitable for powering said signal processing unit.

In one embodiment, only said outer part comprises an energy storage unit suitable for powering said signal processing unit.

In one embodiment, said outer part comprises an energy storage unit, wherein said signal processing unit is configured to be powered by energy drawn from said energy storage unit.

In one embodiment, said outer part comprises an energy storage unit, wherein said signal processing unit is configured to be powered by energy drawn from said energy storage unit, and wherein said energy storage unit is a component of a power supply unit of said hearing device, and wherein at least one further component, e.g., a control circuit or a voltage transformer, is comprised in said inner part.

In one embodiment, the hearing device comprises a wired electrical connection between said inner and said outer part for transferring energy in electrical form from said energy storage unit to said inner part, in particular for powering said signal processing unit.

In one embodiment, said wired electrical connection is comprised at least in part in said connecting portion.

In one embodiment, said wired electrical connection is at least in part integrated in said tube member, more particularly at least in part integrated inside the hollow formed by said tube member and/or within a fringe formed by said tube member (i.e. within material surrounding the hollow of the tube).

In one embodiment, said hearing device comprises a wireless electrical connection between said inner part and said outer part, in particular a wireless electrical connection for transferring energy in electrical form from an energy storage unit comprised in said outer part to said inner part for powering said signal processing unit. In one embodiment, said wireless electrical connection is an inductive connection, i.e. a connection based on inductivity.

In one embodiment, the hearing device comprises a user interface, at least a portion of said user interface being comprised in said outer part. Said user interface can comprise, e.g., a volume control and/or a program selecting control. Since the outer part can be relatively large, this allows to provide a relatively comprehensive user interface and/or a user interface with relatively large user controls.

In one embodiment, said inner part comprises no portion of said user interface, in particular wherein said user interface is fully comprised in said outer part. This way, the inner part can be very small.

In one embodiment, electrical signals generated by means of said user interface are transmitted from said outer part to said inner part via said wired electrical connection. When said user interface is operated, e.g., by turning a volume wheel or by pushing a hearing program selection knob, control signals are generated, and said signal processing unit has to change its operating in dependence of said control signals. Said control signals can be transmitted via said wired electrical connection together with said energy in electrical form, e.g., using modulation. E.g., time multiplexing (time division multiplexing, TDM) or frequency multiplexing (frequency division multiplexing, FDM) may me employed, involving analogue and/or digital signals, the energy transmission from the energy storage unit being at substantially zero Hertz. A bus for data/signal transmission may, of course, be not only based on TDM or FDM or other techniques, but also on combinations of these.

In one embodiment, audio signals outputted from said signal processing unit are transmitted from said inner part to said output transducer via said wired electrical connection.

In one embodiment, said hearing device comprises an antenna for sending or receiving or for both, sending and receiving, data in a wireless fashion, wherein at least a portion of said antenna is comprised in said wired electrical connection.

In one embodiment, the hearing device is configured to establish a bus system on said wired electrical connection.

Via said bus system, e.g., audio signals outputted from said signal processing unit and/or electrical signals originating from a user interface or other signals or data can be transmitted from said outer part or from said connecting portion to said inner part and/or from said inner part to said outer part or to said connecting portion.

For the transmission of different data and/or signals via the same wires such as said wired electrical connection, e.g., frequency multiplexing/FDM and/or time-domain multiplexing/TDM may me employed, which may involve analogue and/or digital signals.

In one embodiment, the hearing device comprises another input transducer comprised in said outer part. In one embodiment, said other input transducer, together with the microphone comprised in said inner part, can form or be comprised in a directional microphone.

In one embodiment, the hearing device is programmable using a programming system or programming device external to the hearing device, in particular, the hearing device comprises a connector for connecting the hearing device to said programming system in a wirebound fashion. Such a connector, e.g., a socket, can be comprised in said inner part or in said outer part or in said connecting portion. It is even possible to provide two or more such connectors, each one in a different part/portion of the hearing device.

The method for operating a hearing device comprising an outer part to be worn behind a hearing device user's ear, an inner part to be worn within the hearing device user's ear, and, interconnected between said outer part and said inner part, a connecting portion, comprises the steps of

- transducing incoming acoustic sound into audio signals by means of an input transducer comprised in said inner part;
- processing said audio signals or audio signals derived therefrom in a signal processing unit comprised in said inner part;
- transducing the so-obtained processed audio signals or audio signals derived therefrom into outgoing acoustic sound by means of an output transducer comprised in said outer part or in said connecting portion.

Said outgoing acoustic sound usually is acoustic sound to be perceived by a user of the hearing device.

In one embodiment, the method comprises guiding said outgoing acoustic sound to said inner part, in particular through said inner part.

The invention comprises methods with features of corresponding hearing devices according to the invention, and vice versa.

The advantages of the methods correspond to the advantages of corresponding apparatuses and vice versa.

Further embodiments and advantages emerge from the dependent claims and the figures.

BRIEF DESCRIPTION OF THE DRAWINGS

Below, the invention is described in more detail by means of examples and the included drawings. The figures show.

The reference symbols used in the figures and their meaning are summarized in the list of reference symbols. The described embodiments are meant as examples and shall not confine the invention.

DETAILED DESCRIPTION OF THE INVENTION

Figure 1:
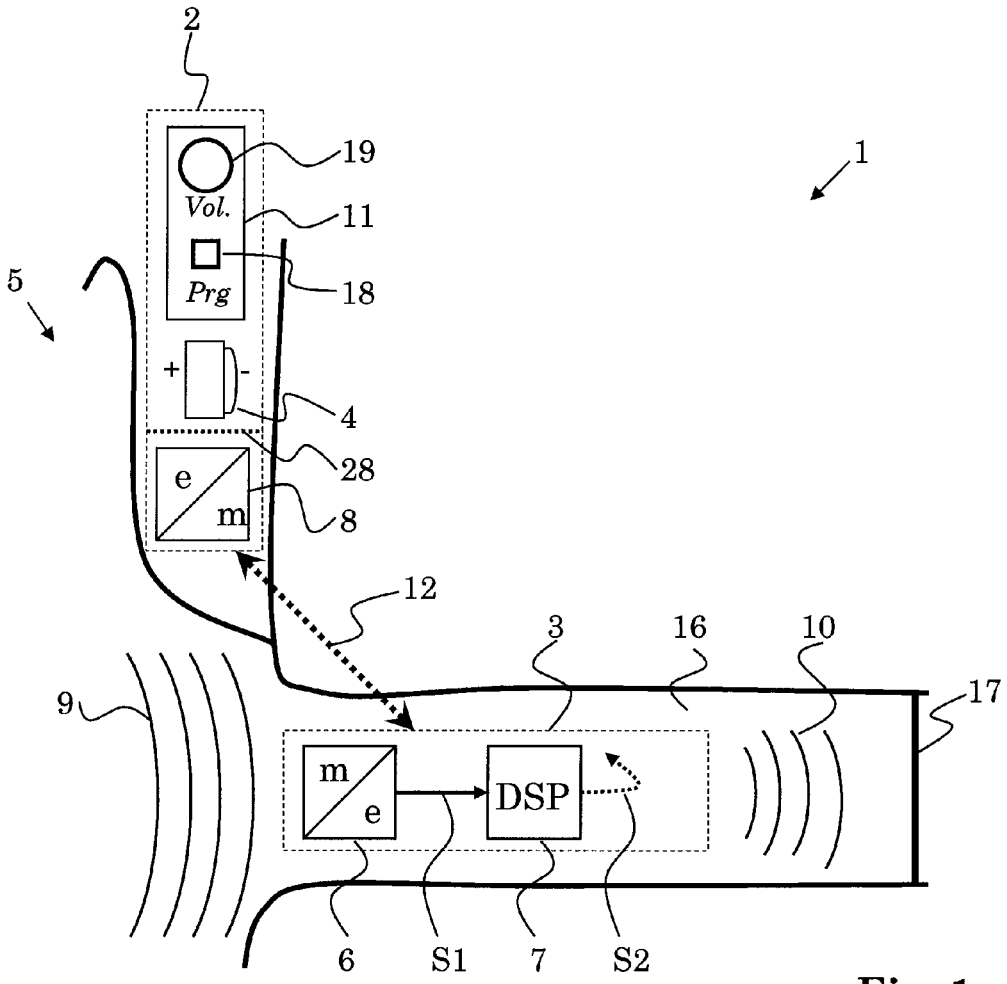
FIG. 1 a partially block-diagrammatical illustration of a hearing device.

FIG. 1 shows a partially block-diagrammatical illustration of a hearing device 1. The hearing device 1 comprises an inner part 3 worn within a user's ear 5, more particularly within the user's ear canal 16, and an outer part 2 worn behind the user's ear, more particularly behind the user's concha. The hearing device 1 furthermore comprises a connecting portion 12, which is symbolized in FIG. 1 by a dotted arrow, and which provides an operational connection between inner part 3 and outer part 2.

The inner part 3 comprises an input transducer 6 such as a microphone or a microphone arrangement, and a signal processing unit 7 such as a digital signal processor (DSP). There is no battery and no other energy storage unit comprised in said inner part 3.

The outer part 2 comprises an output transducer 8 such as a loudspeaker, an energy storage unit 4 such as a battery, and a user interface 11 comprising two user controls, a volume control 19 and a program select button 18. As indicated by reference number 28 (thick dotted line), a portion of outer part 2 comprising output transducer 8 is detachably connected to the rest of outer part 2. This allows, e.g., to detach a portion of outer part 2 for fitting the hearing device 1 to the hearing needs and preference of the hearing device user. E.g., the same detachable connector could be used for connecting said portion of outer part 2 comprising output transducer 8 to said rest of outer part 2 and for connecting said portion of outer part 2 comprising output transducer 8 (and therewith connecting also connecting portion 12 and inner part 3) to a fitting system or fitting device such as a computer with a suitable software. During fitting, an energy storage unit 4 within the hearing device 1 can be dispensed with since energy can be provided via the detachable connection, e.g., from the fitting system, and user interface 11 can be dispensed with, too, since the corresponding functions can be controlled via the detachable connection, e.g., using the fitting system. A useful and high degree of modularity can be obtained by means of said detachable connection (ref. 28).

Basic functions of the hearing device 1 are to convert incoming acoustic sound 9 into audio signals S1, which is accomplished by input transducer 6, and to process these audio signals S1 in dependence of hearing needs and preference of the user, which is accomplished by signal processing unit 7, and to convert the so-obtained audio signals S2 into outgoing sound 10, which is accomplished by output transducer 8. The outgoing sound 10 will reach the user's ear drum 17 in order to be perceived by the user.

The signal processing taking place in signal processing unit 7 can be adjusted by the user by means of the user interface 11.

Figure 2:
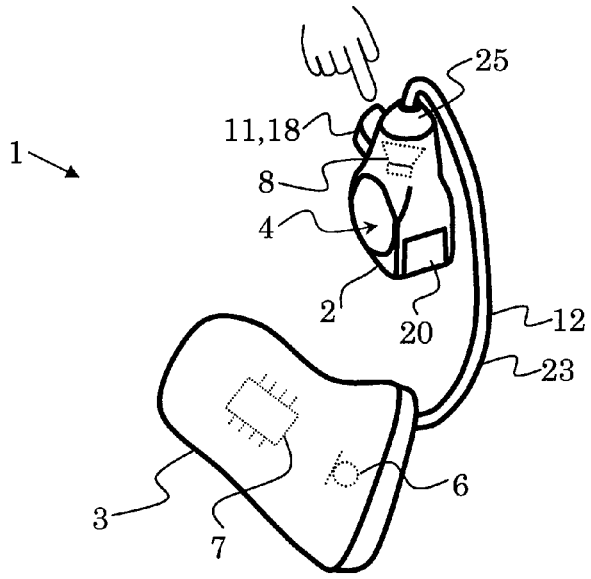
FIG. 2 a partially perspective illustration of a hearing device.

FIG. 2 shows a partially perspective illustration of a hearing device 1. Most of the reference symbols have already been explained above in conjunction with FIG. 1. The shape and size of outer part 2 is strongly influenced by the largest comprised component, i.e. by the battery for which a battery door 20 is provided. The outer part 2 can be considerably smaller than conventional BTE hearing devices, since signal processing unit 7 and input transducer 6 are comprised in inner part 3.

The inner part 3 can be considerably smaller than conventional ITE hearing devices such as ITC and CIC hearing devices, because neither the energy storage unit 4 nor the output transducer 8 has to be comprised in inner part 3. This results in a high wearing comfort. And, the outer shape of inner part 3 can rather easily be designed to be very well adjusted to the user's ear, more particularly to the shape of the user's ear canal. It is well possible to provide a custom-made shell for the inner part which is individually shaped for each user's ear canal shape. But it is also possible, in particular due to the smallness of the inner part, to provide an inner part which is only in part or even not at all individually selected for the user or adjusted to the user's ear canal shape: E.g., the inner part could be the same for all users or for each user of one of a couple of groups of users, while it is provided with a compliant or resilient material such as a soft foam or some other soft elastic material, e.g., a suitable silicone, so as to adjust itself to each user's individual ear canal shape.

Connecting portion 12 comprises a tube member 23 and a plug 25 fitting into a socket provided by outer part 2 allowing to easily separate outer part 2 from inner part 3. Tube member 23 allows to guide acoustic sound generated by output transducer 8 to inner part 3. Furthermore, connecting portion 12 provides a wired connection integrated in tube member 23 which allows to transmit data and/or signals between inner part 3 and outer part 2. Alternatively or additionally, it is possible to provide a wireless connection between inner part 3 and outer part 2 for transmitting data and/or signals between inner part 3 and outer part 2.

Figure 3:
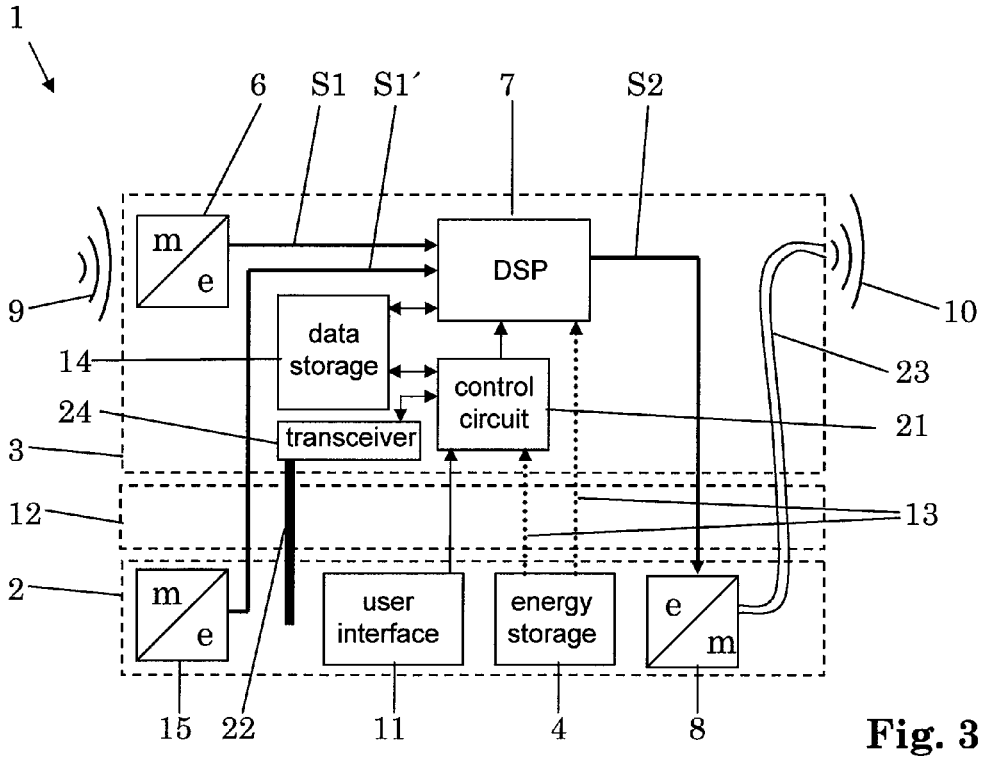
FIG. 3 a block-diagrammatical illustration of a hearing device.

FIG. 3 shows a block-diagrammatical illustration of a hearing device 1 emphasising operational aspects and showing additional components.

In addition to the components shown in FIGS. 1 and 2, FIG. 3 shows an additional input transducer 15, comprised in the outer part 2, which generates audio signals S1', a data storage unit 14 comprised in inner part 3, comprising data individual to the hearing device user, a control unit 21 comprised in inner part 3, which alternatively could be comprised in outer part 2, and a transceiver 24 comprised in inner part 3, which also could alternatively be comprised in outer part 2, and an antenna 22 for use in conjunction with transceiver 24.

Electrical energy is transmitted from energy storage unit 4 in outer part 3 to signal processing unit 7, to control circuit 21 and (not indicated in FIG. 2) to transceiver 24, via wired connection 13. A wireless connection, e.g., using induction, could also be used for that purpose.

The operational connection for transmitting audio signals S1' and/or S2 and/or electrical signals from user interface 11 can be provided by wired connection 13.

A bus system can be established on wired connection 13 for transmitting audio signals S1' and/or S2 and/or said control signals. This is an elegant way of communicating signals and/or data between inner part 3 and outer part 3.

Control circuit 21 controls signal processing unit 7 and transceiver 24 and exchanges data with data storage unit 14. It furthermore receives electrical signals from user interface 11.

Data storage unit 14 is preferably comprised in inner part 3 which facilitates the exchange of data with signal processing unit 7. The data individual to the hearing device user can comprise, e.g., data descriptive of the user's hearing loss and/or data descriptive of signal processing parameter settings adjusted to the hearing needs and preferences of the user.

Transceiver 24 allows to establish communication connections with devices separate from the hearing device 1. The antenna 22 can be comprised in the inner part 3 and/or in the connecting portion 12 and/or in the outer part 2. Preferably, antenna 22 is comprised fully or in part in connecting portion 12. An elegant way to comprise antenna 22 in connecting portion 12 is to use electrical connection 13 as antenna 22 or as a part thereof. A direct current provided by energy storage unit 4 will not interfere with antenna signals. Furthermore, it is also possible to separate antenna signals from other signals possibly transmitted via wired connection 13 such as audio signals S1',S2 and control signals from user interface 11.

The antenna 22 can be used, e.g., for programming (fitting) the hearing device in a wireless fashion, i.e. without galvanically connecting a programming system or device (such as a computer with a suitable programming software) with the hearing device.

The hearing device 1 according to the invention can be considered a modular hearing device. It is possible, confer, e.g., to FIG. 3, to distribute the hearing device components in such a way that predominantly components which are rather individual to the hearing device user are comprised in the inner part 3, which usually will have a shape that is more or less individually adapted to the user's ear (in particular the user's ear canal), whereas components which can or have to be easily replaced are predominantly comprised in the outer part 2. This way, servicing the hearing device is simplified. It is possible, e.g., even to replace the whole outer part 2 by a different outer part having a different shape or color, or by one suitable for a different battery type or with a different user interface, or by one with or without a wired or wireless connectivity. Such a connectivity can be a connectivity to and/or from external devices or systems such one or more microphones, consumer electronics devices (such as music players), communication devices (such as mobile phones), one- or two-way radio equipment, testing hearing device equipment, hearing diagnostics equipment, hearing device fitting equipment, hearing device programming equipment. Said wireless connectivity can based, e.g., on FM (frequency modulation).

Figure 4:
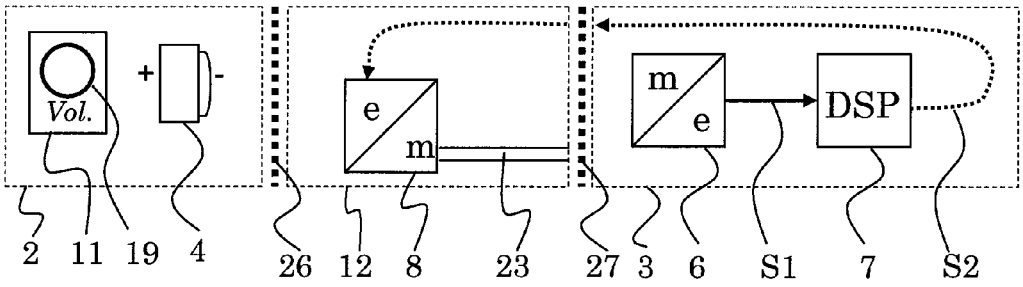
FIG. 4 a block-diagrammatical illustration of a hearing device.

FIG. 4 shows a block-diagrammatical illustration of a hearing device, illustrating another possible way of providing a useful modularity. Most reference numbers have already been explained above. Whereas in the embodiments of FIGS. 1, 2 and 3, the output converter 8 is arranged in the outer part 2, in the embodiment of FIG. 4, it is integrated in connecting portion 12. Connecting portion 12 is detachably connected to at least one of outer part 2 and inner part 3, in particular to both, outer part 2 and inner part 3, as indicated by reference numbers 26 and 27, respectively. Preferably, connecting portion 12 and therewith output transducer 8 is detachably connectable at least to outer part 2. This allows, in a very comparable way to what was explained above with reference to FIG. 1, to fit (adjust) the hearing device to needs and preferences of a hearing device user having a plug or socket connected at 26 (with energy storage unit 4 and user interface 11 removed) so as to provide a connection to an external fitting system, while input transducer 6, output transducer 8 and signal processing unit 7 being still available. For example, output transducer 8 could be integrated in a plug belonging to connecting potion 12 such as—referring to FIG. 2—plug 25.

In general, detachable connections 26, 27, 28 can be realized, e.g., in form of plug-and-socket connections, a plug in one of the interconnected parts and a socket in the other.

Aspects of the embodiments above have been described in terms of functional units. As is readily understood, these functional units may be realized in virtually any number of hardware and/or software components adapted to performing the specified functions.

LIST OF REFERENCE SYMBOLS

1 hearing device
2 outer part
3 inner part
4 energy storage unit, battery
5 ear
6 input transducer, microphone
7 signal processing unit, DSP
8 output transducer, loudspeaker
9 incoming acoustic sound

10 outgoing acoustic sound
11 user interface
12 connecting portion
13 wired electrical connection
14 data storage unit
15 input transducer, microphone
16 ear canal
17 ear drum
18 user control
19 user control
20 battery door
21 control unit, control circuitry
22 antenna
23 tube member
24 transceiver
25 plug
26, 27, 28 detachable connection, connector
S1, S1', S2 audio signals

The invention claimed is:

1. A hearing device comprising:

an outer part to be worn behind an ear of a hearing device user, an inner part to be worn within the ear of the hearing device user, and a connecting portion operationally interconnecting said outer part and said inner part;

wherein an output transducer is positioned in said outer part or in said connecting portion, and wherein said inner part comprises an input transducer for converting incoming acoustic sound into audio signals and a signal processing unit, the signal processing unit being operationally interconnected between said input transducer and said output transducer, the signal processing unit being configured to process the audio signals produced by the input transducer according to hearing needs of the user and settings of the hearing device user to produce processed audio signals to be output by the output transducer as audible sound to be perceived by the hearing device user.

2. The hearing device according to claim 1, characterized in that said connecting portion is detachably connectable to said outer part or detachably connectable to said inner part or detachably connectable to both, said outer part and said inner part.

3. The hearing device according to claim 1 or claim 2, characterized in that a part of said hearing device comprising said output transducer is detachably connectable to at least a portion of said outer part.

4. The hearing device according to claim 1, characterized in that said connecting portion comprises a tube member for providing guidance for acoustic sound outputted from said output transducer to said inner part.

5. The hearing device according to claim 1, further comprising a data storage unit comprising data individual to said hearing device user, wherein said data storage unit is comprised in said inner part.

6. The hearing device according to claim 1, characterized in that no energy storage unit suitable for powering said signal processing unit is comprised in said inner part.

7. The hearing device according to claim 1, characterized in that said outer part comprises an energy storage unit, wherein said signal processing unit is configured to be powered by energy drawn from said energy storage unit.

8. The hearing device according to claim 7, characterized in that said hearing device comprises a wired electrical connection between said inner and said outer part for transferring energy in electrical form from said energy storage unit to said inner part.

9. The hearing device according to claim 8, characterized in that said connecting portion comprises a tube member for providing guidance for acoustic sound outputted from said output transducer to said inner part and said wired electrical connection is at least in part integrated in said tube member.

10. The hearing device according to claim 8, wherein the hearing device comprises a user interface, at least a portion of said user interface being comprised in said outer part.

11. The hearing device according to claim 10, wherein said inner part comprises no portion of said user interface.

12. The hearing device according to claim 10, characterized in that electrical signals generated by means of said user interface are transmitted from said outer part to said inner part via said wired electrical connection.

13. The hearing device according to claim 8, characterized in that audio signals outputted from said signal processing unit are transmitted from said inner part to said output transducer via said wired electrical connection.

14. The hearing device according to claim 8, characterized in that said hearing device comprises an antenna for sending or receiving or for both, sending and receiving, of data in a wireless fashion, wherein at least a portion of said antenna is comprised in said wired electrical connection.

15. The hearing device according to claim 8, characterized in that the hearing device is configured to establish a bus system on said wired electrical connection.

16. The hearing device according to claim 1 wherein the first transducer is positioned within the inner part such that it faces the entrance of the hearing aid user's ear canal.

17. The hearing device according to claim 1 further comprising a second input transducer positioned in the outer part of the hearing device.

18. The hearing device according to claim 17 wherein the input transducer and the second input transducer comprise a directional microphone.

19. A method for operating a hearing device comprising an outer part to be worn behind an ear of a hearing device user, an inner part to be worn within the ear of the hearing device user, and, operationally interconnected between said outer part and said inner part, a connecting portion, said method comprising:

transducing incoming acoustic sound into audio signals by means of an input transducer positioned in said inner part;

processing said audio signals or audio signals derived therefrom in a signal processing unit positioned in said inner part by a signal processor configured to process the audio signals according to the hearing needs and settings of the hearing device user to obtain processed audio signals; and transducing the so-obtained processed audio signals or audio signals derived therefrom into outgoing acoustic sound by means of an output transducer as audible sound to be perceived by the hearing device user, the output transducer being positioned in said outer part or in said connecting portion.

* * * * *